US011976815B2

(12) United States Patent
Umemura et al.

(10) Patent No.: US 11,976,815 B2
(45) Date of Patent: May 7, 2024

(54) MODIFIABLE PREMIX COMBUSTION SYSTEM AND PREMIX BLOWER FOR ELEVATION COMPENSATION

(71) Applicant: Rheem Manufacturing Company, Atlanta, GA (US)

(72) Inventors: Ryosuke Umemura, Montgomery, AL (US); Takashi Nozaki, Pike Road, AL (US); Yoshiki Semba, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 122 days.

(21) Appl. No.: 17/566,751

(22) Filed: Dec. 31, 2021

(65) Prior Publication Data

US 2022/0196237 A1 Jun. 23, 2022

Related U.S. Application Data

(63) Continuation of application No. 16/524,813, filed on Jul. 29, 2019, now Pat. No. 11,215,359.

(51) Int. Cl.

| | |
|---|---|
| ***F23D 14/02*** | (2006.01) |
| ***F23D 14/60*** | (2006.01) |
| ***F23D 14/62*** | (2006.01) |
| *F23D 14/68* | (2006.01) |

(52) U.S. Cl.
CPC ..... *F23D 14/62* (2013.01); *F23D 14/02* (2013.01); *F23D 14/60* (2013.01); *F23D 14/68* (2013.01)

(58) Field of Classification Search
CPC ..... F23D 14/62; F23D 14/02; F23D 14/60; F23D 14/68
USPC ..... 431/12
See application file for complete search history.

(56) References Cited

U.S. PATENT DOCUMENTS

| | | | | |
|---|---|---|---|---|
| 4,708,638 | A * | 11/1987 | Brazier | F23D 11/002 431/182 |
| 6,547,554 | B2 | 4/2003 | Koegl et al. | |
| 6,575,734 | B1 | 6/2003 | Brashears et al. | |
| 8,738,185 | B2 | 5/2014 | Puranen et al. | |
| 2001/0051321 | A1 | 12/2001 | La Fontaine | |
| 2007/0051358 | A1 | 3/2007 | Missoum et al. | |
| 2013/0224669 | A1 | 8/2013 | Ponzi et al. | |
| 2013/0284115 | A1 | 10/2013 | Kim et al. | |
| 2016/0123584 | A1 | 5/2016 | Young et al. | |

* cited by examiner

*Primary Examiner* — Avinash A Savani
(74) *Attorney, Agent, or Firm* — Eversheds Sutherland (US) LLP

(57) ABSTRACT

A combustion system includes a premix blower system and the premix blower system includes an additional air inlet with an adjustable opening which includes an additional reversibly pluggable air intake. The adjustable opening of the additional air inlet can be opened at higher elevations to compensate for thinner air.

20 Claims, 6 Drawing Sheets

MODIFIABLE PREMIX COMBUSTION SYSTEM AND PREMIX BLOWER FOR ELEVATION COMPENSATION

CROSS-REFERENCE TO RELATED APPLICATIONS

The present application is a continuation of U.S. patent application Ser. No. 16/524,813 filed 29 Jul. 2019, the entire contents of which is incorporated herein by reference.

TECHNICAL FIELD

Embodiments described herein relate generally to premix combustion systems and premix blowers that can be used at both low and high elevations, and more particularly to premix systems and premix blowers with additional air flow inlets which can be blocked at low elevations and opened at high elevations.

BACKGROUND

Boilers, pool heaters, water heaters, furnaces, and other similar devices are used to heat various types of liquids. These devices often use a burner in connection with a combustion process which takes in air and fuel for combustion to produce a heated fluid. For a typical premix combustion system, as the premix blower rotates, a certain amount of air is pulled through the air inlet along with a respective amount of fuel. The air and fuel are then mixed into a combustible mixture in order to achieve clean combustion and low NOx emission levels. As the blower rotates faster or slower, the amount of air and fuel increases or decreases, respectively. The blower speed and the amount of air/fuel mixture are proportional. While the premix system is designed to achieve clean combustion and low NOx levels at sea level, the system struggles to meet the same level of combustion and low NOx level at high elevation, where the density of air is rare (less dense), resulting in a richer mixture of air and fuel, leading to poor combustion.

Referring to the attached figures, FIG. 1 is a schematic diagram showing a premix blower assembly 100. The premix blower assembly 100 comprises a premix blower 102, an air inlet 104, a fuel inlet 106, a venturi tube 108, a venturi tube inlet 110, and a venturi tube outlet 112. When the premix blower rotates, air is pulled in through the air inlet 104 and travels from the air inlet 104 through the venturi inlet 110 and into the venturi tube 108. Since the cross-sectional area of the venturi tube inlet 110 is smaller than that of the air inlet 104, air at the venturi tube inlet 110 moves faster than at the air inlet 104. Since air speed at the venturi inlet 110, v2, is faster than that at the air inlet 104, v1, air pressure at venturi inlet 110, p2, is lower than that at the air inlet 104, p1. Therefore, air pressure at venturi inlet 110, p2, becomes lower than other areas. Fuel (i.e. natural gas or propane gas) is introduced through a fuel inlet 106 from a fuel source (not shown). The air and fuel are mixed inside venturi tube 108, and this mixed gas passes through the venturi outlet 112. Air and fuel are further mixed at the premix blower 102, and mixed gas is delivered to a premixed burner (not shown).

With a typical tankless water heater, the speed of the blower is typically adjusted for high elevation installation to attempt to achieve clean combustion and NOx emission levels. However, changing only the premix blower speed, as is currently done in the art, does not keep the ratio of oxygen to fuel the same as is used at lower elevations, resulting in higher NOx emission levels when at a higher elevation due to the rarer nature of oxygen in the same volume of air. That is, because the air is "thinner" at higher elevations and contains less oxygen per volume than at lower elevations, the ratio of oxygen to gas does not remain constant as elevation increases.

The instant disclosure describes a new system and method which optimizes the amount of oxygen to fuel at different elevations.

SUMMARY

In general, in one aspect, the disclosure relates to a premix blower assembly for a thermal transfer device comprising a premix blower, a first air inlet fluidly connected to the premix blower, a fuel inlet fluidly connected to the premix blower, a second air inlet fluidly connected to the premix blower, wherein the second air inlet comprises an adjustable opening. In some embodiments, the premix blower further comprises a venturi tube configured to receive air from the first air inlet and fuel from the fuel inlet. The second air inlet can be located inside of the first air inlet, next to the first air inlet, or separate from the first air inlet. In some embodiments, the second air inlet directly fluidly connects to the premix blower. In other embodiments, the second air inlet directly fluidly connects to a side of the venturi tube. The adjustable opening can comprise one of a stopper, a valve, a shutter, or a baffle, for example.

Another general embodiment of the disclosure is a water heating system comprising a premix blower assembly comprising, a premix blower, a first air inlet fluidly connected to the premix blower, a fuel inlet fluidly connected to the premix blower, and, a second air inlet fluidly connected to the premix blower, wherein the second air inlet comprises an adjustable opening, a manifold configured to receive a mixture of air and fuel from the premix blower assembly, a combustion chamber fluidly connected to the manifold, water inlet, a heat exchanger fluidly connected to the combustion chamber, a heat exchanger pipe running through the heat exchanger comprising a heat exchange inlet fluidly connected to the water inlet; a hot water outlet fluidly connected to a heat exchange outlet of the heat exchanger pipe, and, an exhaust fluidly connected to the heat exchanger. In some embodiments, the premix blower further comprises a venturi tube configured to receive air from the first air inlet and fuel from the fuel inlet. In certain embodiments, the second air inlet is located inside of the first air inlet. In other embodiments, the second air inlet directly fluidly connects to the premix blower. In some embodiments, the second air inlet directly fluidly connects to a side of the venturi tube. In certain embodiments, the adjustable opening comprises a stopper, a valve, a shutter, or a baffle. The tankless water heater can further comprise an elevation sensor. In an additional embodiment, the tankless water heater system further comprises a controller, wherein the controller comprises processing circuitry, and wherein the controller is configured to receive a value associated with an elevation, determine if the second air inlet should be opened based on the value, and send a signal to the adjustable opening to open if so determined.

An pre-mix combustion system comprising, a premix blower assembly comprising, a premix blower, a first air inlet fluidly connected to the premix blower, a fuel inlet fluidly connected to the premix blower, and, a second air inlet fluidly connected to the premix blower, wherein the second air inlet comprises an adjustable opening, an air and fuel mixing chamber, a burner fluidly connected to the air and fuel mixing chamber, a heat exchanger configured to receive heated gases from the burner and transfer heat from the heated gases through one or more heat exchanger tubes, and, an exhaust fluidly connected to the heat exchanger. In some embodiments the mixing chamber comprises a manifold. The premix combustion system can be a furnace, a pool heater, a tankless water heater, or a tanked water heater, for example. The premixed combustion system of claim 15, wherein the premix blower further comprises a venturi tube configured to receive air from the first air inlet and fuel from the fuel inlet. The adjustable opening can comprise a stopper, a valve, a shutter, or a baffle, for example. In some embodiments, the premixed combustion system further comprises a controller, wherein the controller comprises processing circuitry, and wherein the controller is configured to receive a value associate with an elevation, determine if the second air inlet should be opened based on the received value, and send a signal to the adjustable opening to open if so determined.

These and other aspects, objects, features, and embodiments will be apparent from the following description and the appended claims.

BRIEF DESCRIPTION OF THE DRAWINGS

The drawings illustrate only example embodiments of modifiable premix combustion systems and premix blower assemblies and are therefore not to be considered limiting of its scope, as modifiable premix combustion systems and premix blower assemblies may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1:
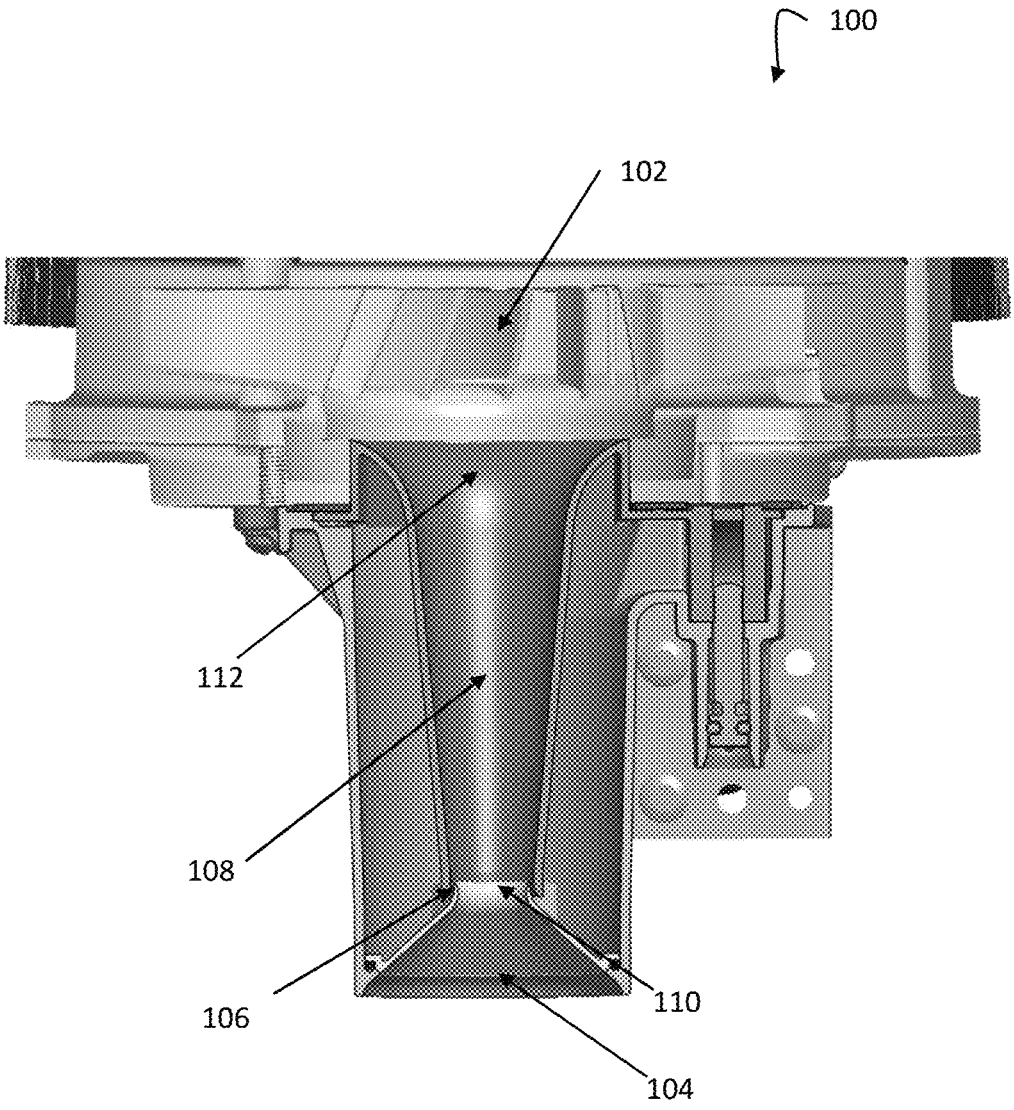
Fig. 1 Prior art
FIG. 1 is a schematic illustration of a premix blower assembly as known in the prior art.

The example embodiments discussed herein are directed to systems, methods, and devices for premix combustion systems which are configurable to change the amount of air entering the combustion system, thus, allowing a greater volume of air input in a higher elevation installation and a less volume of air at a lower elevation installation. Example embodiments can be directed to any of a number of thermal transfer devices that include premix combustion systems, including but not limited to furnaces, boilers, condensing boilers, pool heaters, heat exchangers, and water heaters (tanked and tankless). To compensate for the reduction in the amount of oxygen in a standard volume of air for a high elevation installation, the total volume of the air passageways is adjustable through the use of multiple air passageways that can open or close as shown in the example embodiments described herein. While the examples illustrated herein use a plug to block or open an additional air passageway, in alternate embodiments, the volume of air intake can be adjusted by an adjustable opening that can include movable louvers, gates, shutters, valves, or baffles, as non-limiting examples. The adjustable opening can be opened, closed, or partially opened to control the flow of air into the premix blower assembly. In low elevation installations the additional passageway(s) are blocked and in high elevation installations the additional passageways are opened. Thus, in a high elevation installation a higher volume of less dense air is delivered with the same amount of fuel, thus, maintaining the proper fuel/air mixture for clean combustion.

Any component described in one or more figures herein can apply to any other figures having the same label. In other words, the description for any component of a figure can be considered substantially the same as the corresponding component described with respect to another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein. For any figure shown and described herein, one or more of the components may be omitted, added, repeated, and/or substituted. Accordingly, embodiments shown in a particular figure should not be considered limited to the specific arrangements of components shown in such figure.

Example embodiments of modifiable premix combustion systems and premix blower assemblies will be described more fully hereinafter with reference to the accompanying drawings, in which example embodiments of modifiable premix combustion systems and premix blower assemblies are shown. Modifiable premix combustion systems and premix blower assemblies may, however, be embodied in many different forms and should not be construed as limited to the example embodiments set forth herein. Rather, these example embodiments are provided so that this disclosure will be thorough and complete, and will fully convey the scope of modifiable premix combustion systems and premix blower assemblies to those of ordinary skill in the art. Like, but not necessarily the same, elements (also sometimes called components) in the various figures are denoted by like reference numerals for consistency.

Terms such as "first," "second," "top," "bottom," "left," "right," "end," "back," "front," "side", "length," "width," "inner," "outer," "lower", and "upper" are used merely to distinguish one component (or part of a component or state of a component) from another. Such terms are not meant to denote a preference or a particular orientation, and are not meant to limit embodiments of modifiable premix combustion systems and premix blower assemblies. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 2:
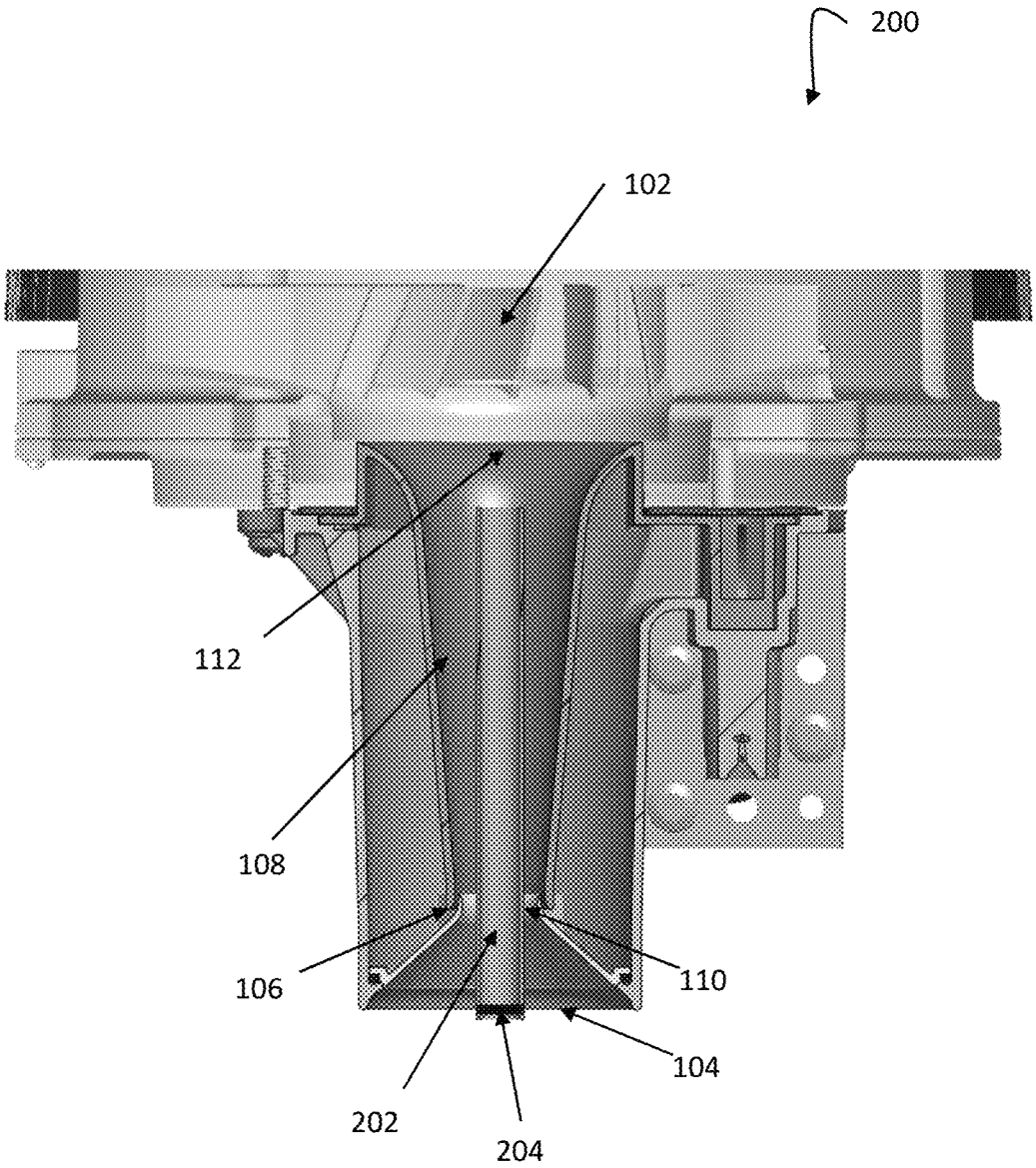
FIG. 2 is a schematic illustration of an example premix blower assembly comprising an additional air passageway in accordance with the example embodiments described herein.

FIG. 2 illustrates an example of a premix blower assembly 200 of the disclosure. The premix blower assembly 200 comprises a premix blower 102, an air inlet 104, a fuel inlet 106, a venturi tube 108, a venturi inlet 110, a venturi outlet 112, a second air inlet 202 and a plug 204. It is understood that the air inlet 104 is unplugged and fully open to let in air. The second air inlet 202 is shown in this illustration as being fully blocked by plug 204. In this example, the plug 204 is a stopper. The plug 204 is reversibly removable, such that when a combustion device comprising the premix blower assembly 200 is installed at a lower elevation, the stopper stays in, and when it is installed in a higher elevation, the stopper is removed. In this way, at a higher elevation, a greater volume of air is pulled into the fuel/air mixture, resulting in a higher ratio of air to fuel, but the same ratio of oxygen to fuel as that of a lower elevation.

"Plug," as used herein, is used broadly to encompass any component that stops the flow of fluid within a passageway. "Removing a plug," as used herein, broadly encompasses changing the plug such that a flow of fluid is allowed within a passageway. For example, removing a plug includes removing a stopper from a passage way, opening a valve, opening a shutter, or rotating a baffle. Additionally, a "premix blower" is a blower or fan that mixes air and fuel before combustion. The premix blower can also simply be referred to as a blower or fan.

Figure 3:
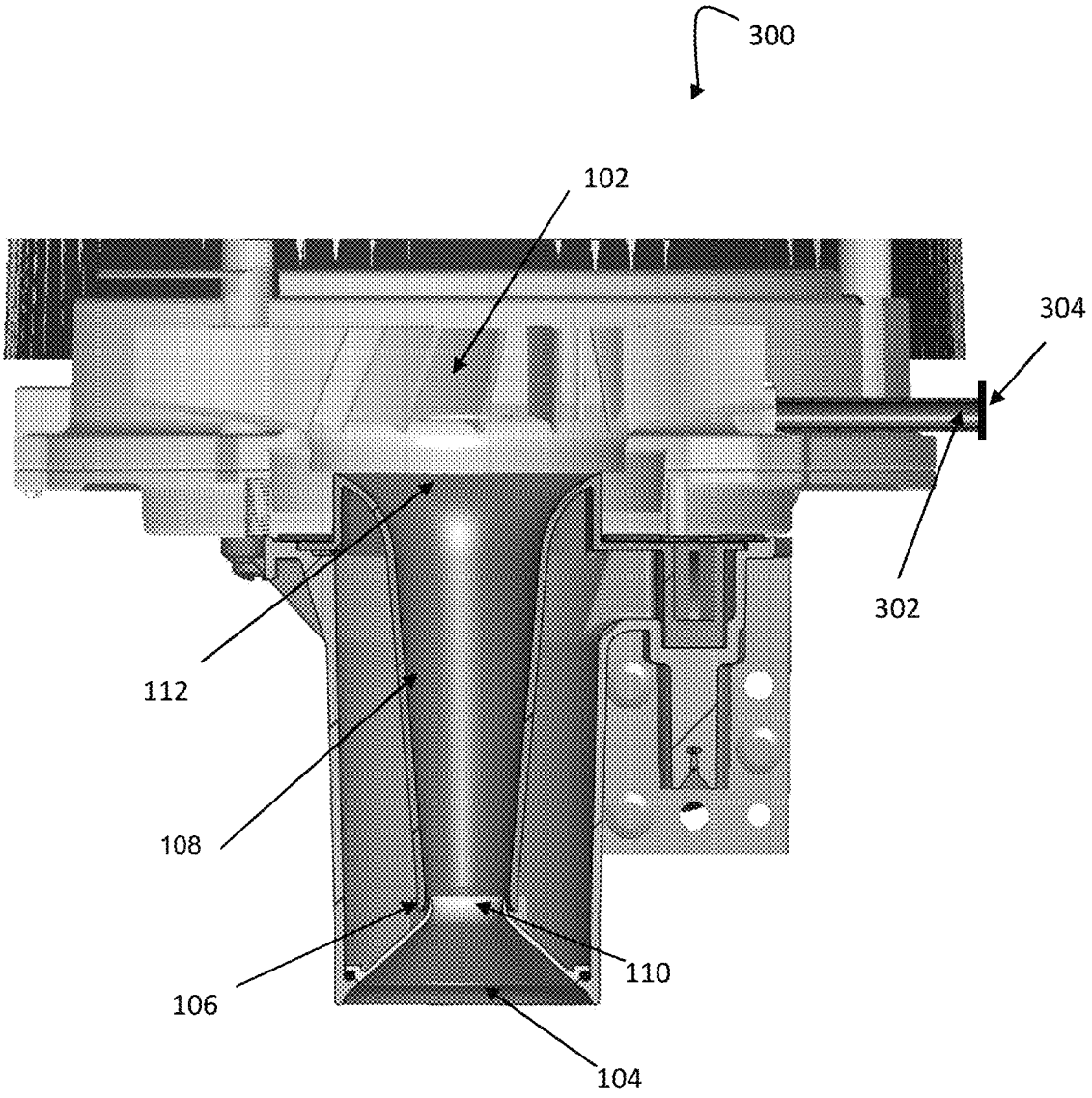
FIG. 3 is a schematic illustration of a premix blower assembly comprising an additional air passageway in accordance with the example embodiments described herein.

FIG. 3 illustrates another example of a premix blower assembly 300 of the disclosure. The premix blower assembly 300 comprises a premix blower 102, an air inlet 104, a fuel inlet 106, a venturi tube 108, a venturi inlet 110, a venturi outlet 112, a second air inlet 302 and a plug 304. The second air inlet 302 is shown in this illustration as being fully blocked by plug 304. In this example, the plug 304 is a stopper. The plug 304 is reversibly removable, such that when a combustion device comprising the premix blower assembly 300 is installed at a lower elevation, the stopper stays in, and when it is installed in a higher elevation, the stopper is removed. In this way, at a higher elevation, a greater volume of air is pulled into the fuel/air mixture, resulting in a higher ratio of air to fuel, but the same ratio of oxygen to fuel as that of a lower elevation.

Figure 4:
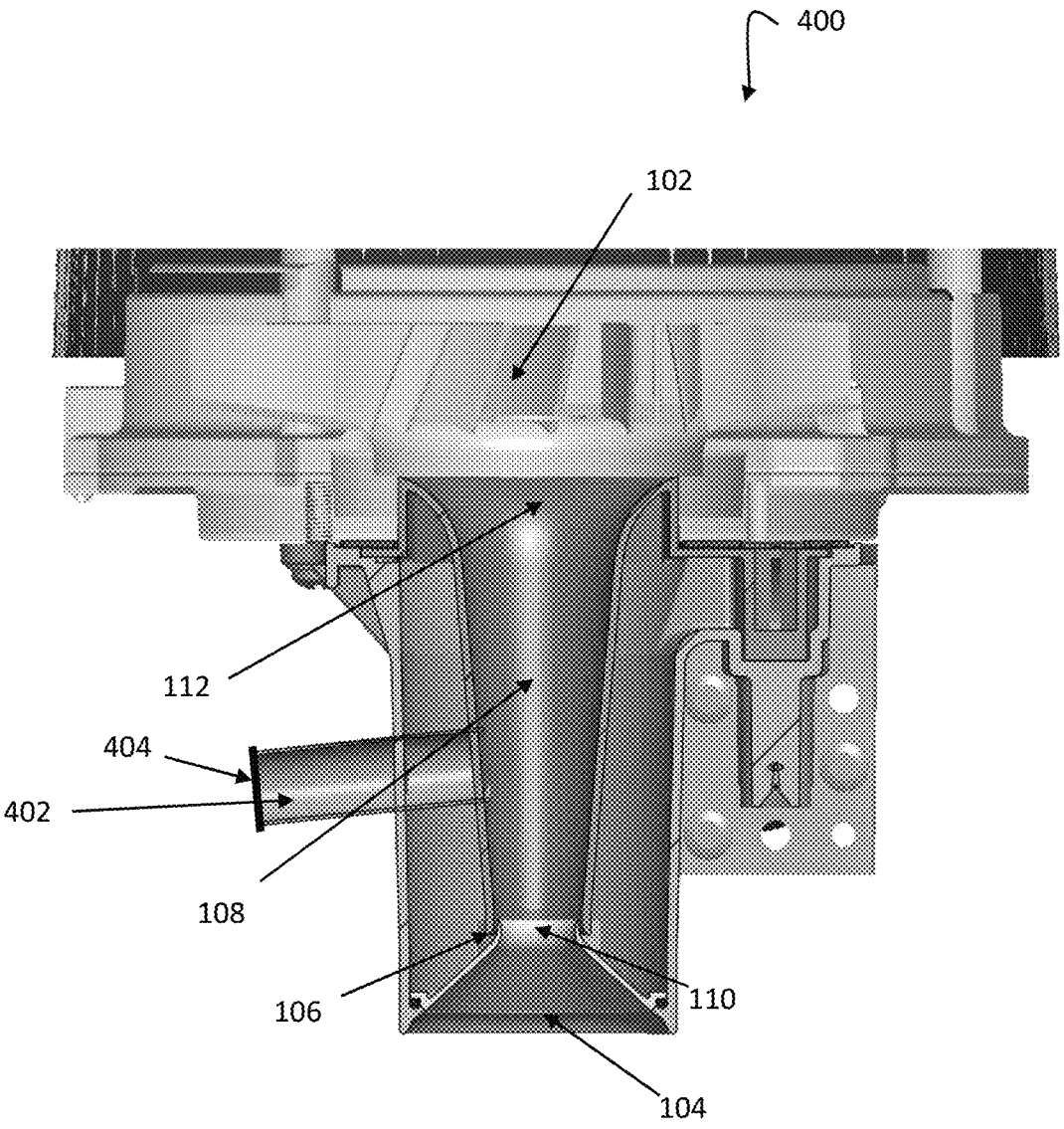
FIG. 4 is a schematic illustration of a premix blower assembly comprising an additional air passageway in accordance with the example embodiments described herein.

FIG. 4 illustrates another example of a premix blower assembly 400 of the disclosure. The premix blower assembly 400 comprises a premix blower 102, an air inlet 104, a fuel inlet 106, a venturi tube 108, a venturi inlet 110, a venturi outlet 112, a second air inlet 402 and a plug 404. The second air inlet 402 is shown in this illustration as being fully blocked by plug 404. In this example, the plug 304 is a stopper. The plug 404 is reversibly removable, such that when a combustion device comprising the premix blower assembly 400 is installed at a lower elevation, the stopper stays in, and when it is installed in a higher elevation, the stopper is removed. In this way, at a higher elevation, a greater volume of air is pulled into the fuel/air mixture, resulting in a higher ratio of air to fuel, but the same ratio of oxygen to fuel as that of a lower elevation.

While FIGS. 2-4 illustrate an embodiment with a venturi type premix blower, it is understood that embodiments of this disclosure can be used in any type of premix blower, including those that do not use a venturi tube. Other embodiments of premix blowers include premix blowers where the fuel intake is located at the fan outlet while the air intake is located at the fan inlet. Premix blowers can also comprise gas tight housings, anti-static backward curbed impellers, speed modulating motor, can be made of non-sparking material, and other modifications. The premix gas blower can be controlled automatically or by a controller. The premix blower functions to blow the air and fuel towards the burner for combustion and to blow the combustion products into the heat exchanger.

The various configurations, including the size, length, position of the additional passageway, also referred to herein as second air intakes, described herein provide a method of modifying the premixed combustion system to operate at different elevations. Example embodiments can also be used in environments that require compliance with one or more standards and/or regulations. Example embodiments can be customizable with respect to any of a number of characteristics (e.g., size, shape, length, position, fuel type). Further, the shape, size, and dimensions of an additional passageway can be specifically configured for a particular premix blower assembly. Example embodiments can be mass produced or made as a custom order.

In some example embodiments, the plug is a removable type plug, such as a rubber stopper, that obstructs the additional passageway such that fluids cannot move through the additional passageway. In some embodiments, the plug is a valve that can either be open or closed. In some embodiments, the plug is a valve that can be open, closed, or partially opened. In some embodiments, the plug is a shutter that can be opened, closed, or partially opened. In some embodiments, the plug is a baffle that can be opened, closed, or partially opened.

In some example embodiments, the plug is configured to be removed when above a predetermined elevation. For example, the plug should be removed at elevations at or above 1,500 ft., 1,600 ft., 1,700 ft., 1,800 ft., 1,900 ft., 2,000 ft., 2,500 ft., 3,000 ft., 4,000 ft., 5,000 ft., 6,000 ft., 7,000 ft., 8,000 ft., 9,000 ft., or 10,000 ft. As used herein, "a high elevation" refers to an elevation above 2,000 ft.

The exact amount of air needed to completely burn a given amount of fuel is known as the stoichiometric mixture. Ratios higher than the stoichiometric mixture are considered rich, while lower ratios are considered lean. For example, at sea level a stochiometric mixture is 24 air to 1 propane or 10 air to 1 natural gas. At an elevation of 5,000 ft. a stochiometric mixture is 28 air to 1 propane; or 12 air to 1 natural gas. At an elevation of 10,000 ft. a stochiometric mixture is 33 air to 1 propane; or 14 air to 1 natural gas. The amount of air should increase by about 6-7% per 2,000 ft. Therefore, the ratio by volume can be about what is shown below in Table 1.

TABLE 1

| Elevation | Air Density | Ratio | | Ratio | |
|---|---|---|---|---|---|
| (ft) | (lb/cu ft) | NAT | Air | LP | Air |
| 0 | 0.077 | 10.0 | 1 | 24.0 | 1 |
| 2000 | 0.072 | 10.7 | 1 | 25.7 | 1 |
| 4000 | 0.068 | 11.3 | 1 | 27.2 | 1 |
| 5000 | 0.066 | 11.7 | 1 | 28.0 | 1 |
| 6000 | 0.064 | 12.0 | 1 | 28.9 | 1 |
| 8000 | 0.06 | 12.8 | 1 | 30.8 | 1 |
| 10000 | 0.056 | 13.8 | 1 | 33.0 | 1 |

The premix combustion system (or components thereof) described herein can be made of one or more of a number of suitable materials and/or can be configured in any of a number of ways to allow the premix combustion system to meet certain standards and/or regulations while also maintaining reliability, regardless of the one or more conditions under which the systems can be exposed. Examples of such materials can include, but are not limited to, aluminum, stainless steel, ceramic, fiberglass, plastic, and rubber.

As discussed above, modifiable premix combustion systems and premix blower assemblies can be subject to complying with one or more of a number of standards, codes, regulations, and/or other requirements established and maintained by one or more entities. Examples of such entities can include, but are not limited to, the American Society of Mechanical Engineers (ASME), American Society of Heating, Refrigeration and Air Conditioning Engineers (ASHRAE), Underwriters' Laboratories (UL), American National Standard Institute (ANSI), the National Electric Code (NEC), and the Institute of Electrical and Electronics Engineers (IEEE). Example modifiable premix combustion systems and premix blower assemblies allow a vessel (e.g., water heater, pool heater, furnace, boiler, heat exchanger) to continue complying with such standards, codes, regulations, and/or other requirements. In other words, any additional passageways, blocked or unblocked, within the premix combustion systems, do not compromise compliance of the system with any applicable codes and/or standards. In contrast, the additional adjustable air passageway can expand the range of compliance for the premix combustion system because the system can more cleanly burn fuel at a greater range of elevation.

Figure 5:
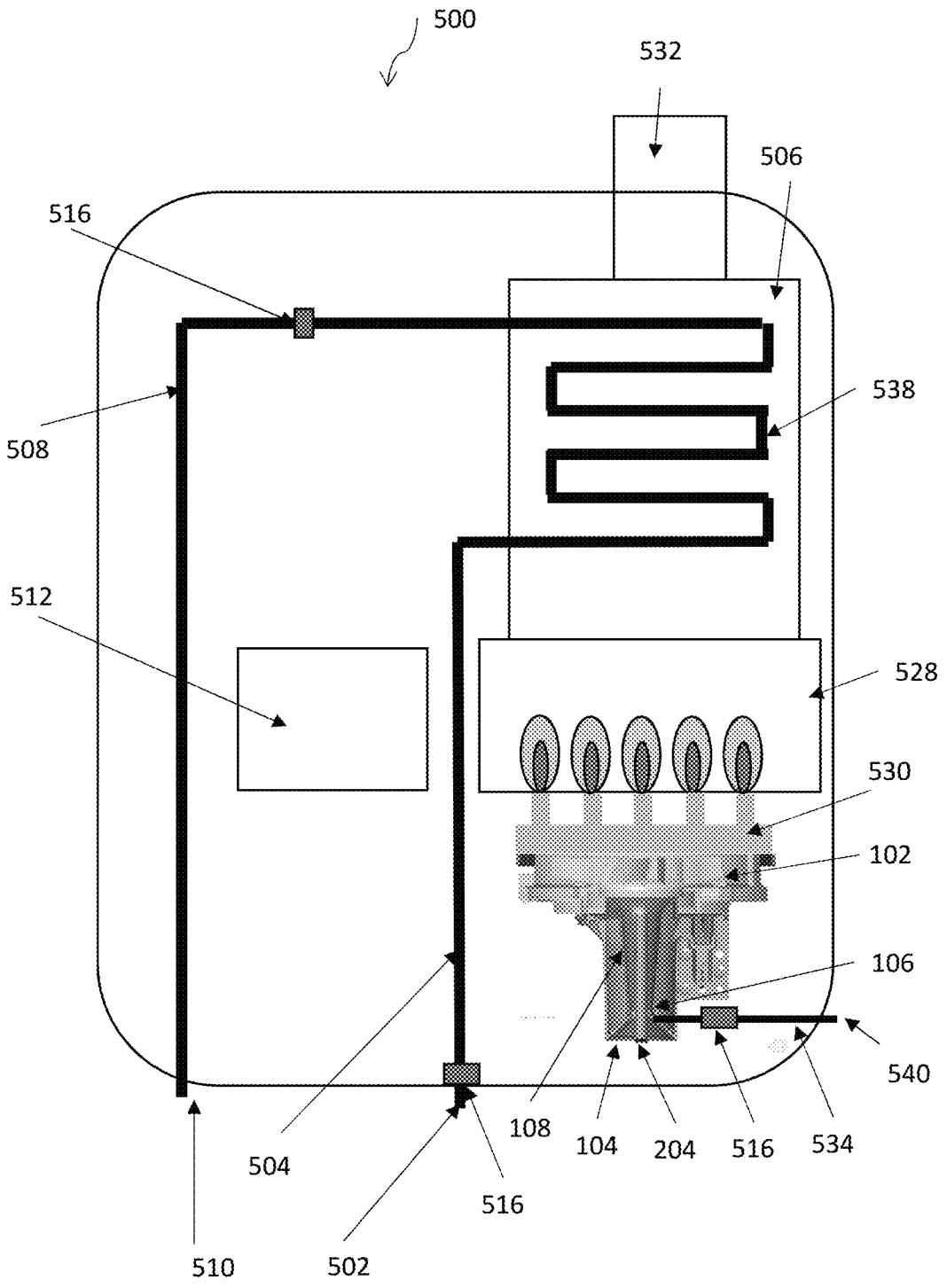
FIG. 5 is a schematic illustration of the example premix blower assembly of FIG. 2 installed in an example tankless water heater.

A specific example of a modifiable premix combustion system is shown in FIG. 5. FIG. 5. illustrates an example tankless water heater 500 with an additional adjustable air inlet (second air inlet 202). The tankless water heater 500 includes a water inlet fitting 502 connected to a water inlet line 504 which typically receives unheated water from a municipal water source or a well. Water flows into the water inlet line 504 and then into the heat exchanger 506 which uses fuel to generate heat which is then exchanged with the water, thereby heating the water. The heated water can then flow out of the tankless water heater 500 through a water outlet line 508 and an outlet fitting 510 which can be connected to hot water pipes. The operation of the tankless water heater 500 is controlled by a controller 512.

Also included in the tankless water heater 500 are a combustion chamber 528 (containing a burner), a premix blower 102, a manifold 530, and a vent 532. The ignitor 528 of the tankless water heater 500 can be a flame or other source of heat that is ignited or otherwise initiated when a demand for heated water is detected. Fuel (e.g., natural gas, propane, and air) enters the premix blower assembly at the fuel inlet 106 while air enters the premix blower assembly at the air inlet 104. The gas inlet line 534 is connected to a gas fitting 540 and then to an exterior source of fuel (not shown). The fuel and air mix at the venturi tube 108 and in the premix blower 102, entering the manifold 530 as an air/fuel mixture. The air/fuel mixture moves through the manifold 530 and is ignited at the ignitor 528, creating a heated fluid of combustion products which moves through the heat exchanger 506 and out of the tankless water heater 500 through the vent 532.

The tankless water heater 500 can include multiple signal and/or power transfer links (not shown). The signal and/or power transfer links can also be used to transfer signals and/or power between the tankless water heater 500 components. For example, between the controller 512 and any one of the valves 516; between the controller 512 and the premix blower 102; and between the controller 512 and the igniter 528. Signal transfer links can be wired or wireless. The premix blower 102 can be controlled automatically or by the controller 112.

A heat exchanger coil 538 is filled with water that is circulated therethrough. One end of the coil 538 is coupled to the water inlet line 504, thereby receiving unheated water. As the water circulates through the coil 538 it continues to absorb heat from combustion products passing along the outside of the coil 538. The water in the coil 538 can be circulated using a pump, gravity, pressure differentials, and/or any other method for circulating water. When the water reaches the other end of the coil 538 of the heat exchanger 506, the water has absorbed enough heat to become heated water. The other end of the coil 538 of the heat exchanger 506 is coupled to the water outlet line 508 and can deliver the heated water to a pipe connected to the outlet fitting 510.

Those of ordinary skill in the art will appreciate that a tankless water heater system can have any of a number of configurations. In any case, a controller can be aware of the devices, components, ratings, positioning, and any other relevant information regarding the tankless water heater. The tankless water heater can also include a number of other components generally considered part of the appliance system which are not shown for conciseness.

The premix blower assembly of the disclosure can be used in any configuration of a tankless water heater that uses a premix blower assembly. In some embodiments, the premix blower assembly of the disclosure can be installed in other premix combustion systems such as a furnace, a water heater with a tank, a boiler, a pool heater, or other such premix combustion systems.

Any example modifiable premix combustion systems and premix blower assemblies, or portions thereof, described herein can be modified with passageways made from a single piece (e.g., as from a mold, injection mold, die cast, 3-D printing process, extrusion process, stamping process, or other prototype methods). In addition, or in the alternative, an additional passageway (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably. Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling. As used herein, "fluidly connected" refers to a connection that is fluid tight; the connection does not need to be a direct connection and multiple different fluid tight components may exist between the two components that are fluidly connected. As used herein, "directly fluidly connected" refers to two components that are directly connected to each other and are fluid tight.

A portion of an additional passageway can be coupled to a premix blower using one or more independent devices that interact with one or more coupling features disposed on a component of the additional passageway. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature as described herein can be a coupling feature that mechanically couples, directly or indirectly, with another coupling feature.

Figure 6:
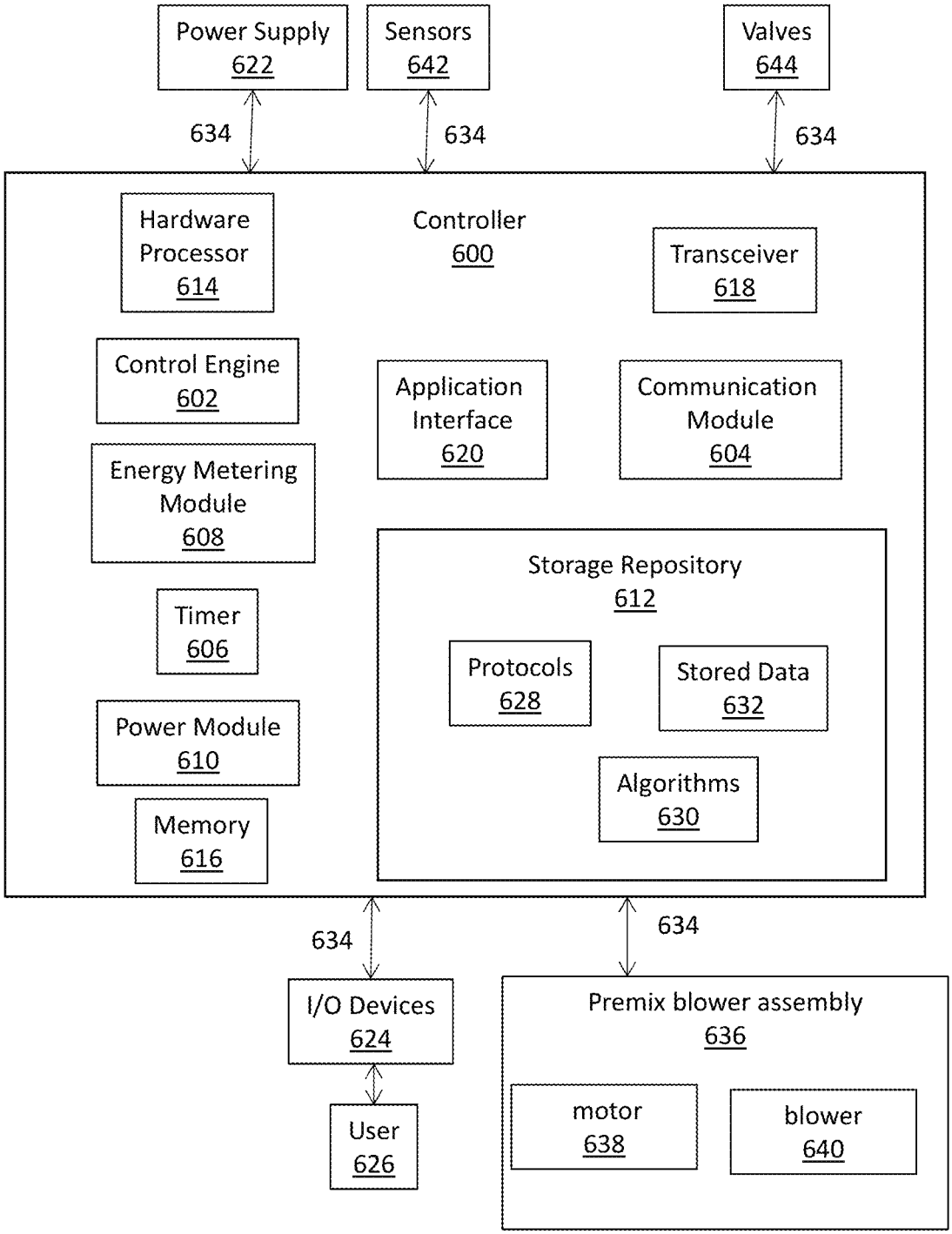
FIG. 6 is a block diagram of a controller for use in a premix combustion system comprising a premix blower assembly in accordance with the example embodiments described herein.

FIG. 6 is an example embodiment of a controller 600 that is integrated into a premix combustion system and can include one or more of a number of components. Such components, can include, but are not limited to, a control engine 602, a communication module 604, a timer 606, an energy metering module 608, a power module 610, a storage repository 612, a hardware processor 614, a memory 616, a transceiver 618, and an application interface 620. FIG. 6 also illustrates example connections of the controller 600 to one or more input/output (I/O) devices 624, user 626, sensors 642, valves 644, and a power supply 622. A bus (not shown) can allow the various components and devices to communicate with one another. A bus can be one or more of any of several types of bus structures, including a memory bus or memory controller, a peripheral bus, an accelerated graphics port, and a processor or local bus using any of a variety of bus architectures. A bus can include wired and/or wireless buses. The components shown in FIG. 6 are not exhaustive, and in some embodiments, one or more of the components shown in FIG. 6 may not be included in an example system. Further, one or more components shown in FIG. 6 can be rearranged. Any component of the example controller can be incorporated into a tankless water heater and can be discrete or combined with one or more other components of a tankless water heater.

A user 626 is optional and may be any person or entity that interacts a tankless water heater and/or the controller 600. Examples of a user 626 may include, but are not limited to, an engineer, an appliance or process that uses heated water, an electrician, an instrumentation and controls technician, a mechanic, an operator, a consultant, a contractor, a homeowner, a landlord, a plumber, an installer, a building management company, and a manufacturer's representative. There can be one or multiple users 626. The user 626 can use a user system (not shown), which may include a display (e.g., a GUI).

Each signal transfer link 634 can include wired (e.g., Class 1 electrical cables, Class 2 electrical cables, electrical connectors, electrical conductors, electrical traces on a circuit board, power line carrier, DALI, RS485) and/or wireless (e.g., Wi-Fi, visible light communication, cellular networking, Bluetooth, WirelessHART, ISA100) technology. For example, a signal transfer link 634 can be (or include) one or more electrical conductors that are coupled to the controller 600. A signal transfer link 634 can transmit signals (e.g., communication signals, control signals, data) between the controller 600, the user 626, the tankless water heater (including components thereof), and/or the power supply 622.

The power supply 622 provides power to one or more components (e.g., the controller 600) of a tankless water heater. The power supply 622 can include one or more of a number of single or multiple discrete components (e.g., transistor, diode, resistor), and/or a microprocessor. The power supply 622 may include a printed circuit board, upon which the microprocessor and/or one or more discrete components are positioned. The power supply 622 can include one or more components (e.g., a transformer, a diode bridge, an inverter, a converter) that receives power (for example, through an electrical cable) from an independent power source external to the water heater and generates power of a type (e.g., AC, DC) and level (e.g., 12V, 24V, 120V) that can be used by one or more components of the tankless water heater. In addition, or in the alternative, the power supply 622 can be a source of power in itself. For example, the power supply 622 can be a battery, a localized photovoltaic power system, or some other source of independent power.

The application interface 620 of the controller 600 can receive data (e.g., information, communications, instructions, updates to firmware) from and can send data (e.g., information, communications, instructions) to the user 626, the power supply 622, and/or other components of a tankless water heater. The user 626, the power supply 622, and other components of a tankless water heater can include an interface to receive data from and send data to the controller 600 in certain example embodiments.

The storage repository 612 can be a persistent storage device (or set of devices) that stores software and data used to assist the controller 600 in communicating with the user 626, the power supply 622, and other components of the tankless water heater. In one or more example embodiments, the storage repository 612 stores one or more protocols 628, algorithms 630, and stored data 632. The protocols 628 can be any procedures (e.g., a series of method steps) and/or other similar operational procedures that the control engine 602 of the controller 600 follows based on certain conditions at a point in time. The protocols 628 can include any of a number of communication protocols 628 that are used to send and/or receive data between the controller 600 and the user 626, the power supply 622, and the water heater. A protocol 628 can be used for wired and/or wireless communication. Examples of a protocol 628 can include, but are not limited to, Modbus, profibus, Ethernet, and fiberoptic.

The algorithms 630 can be any formulas, logic steps, mathematical models, and/or other suitable means of manipulating and/or processing data. One or more algorithms 630 can be used for a particular protocol 628. As discussed above, the controller 600 can use information provided by sensors 642 or user input to generate, using one or more protocols 628 and/or one or more algorithms 630, information regarding the elevation of the system.

For example, a protocol 628 and/or an algorithm 630 can receive elevation information from an elevation sensor, calculate the amount of air needed for the proper ratio of oxygen to fuel, and automatically transmit instructions through the controller to open or close a valve in the additional air passageway (second air input). The protocol 628 and/or algorithm 630 can also calculate a percentage of additional air needed from the additional air passageway (second air input) and automatically transmit instructions through the controller to partially open a valve to the correct position in order to provide the correct ratio of air to fuel. Elevation information can be received from a sensor, such as an elevation senor, or elevation information can be received from a user. For example, a user can enter in the actual installation elevation (i.e. feet or meters from sea level) or can be prompted to enter a binary response indicating whether the installation is performed at a high elevation, i.e., higher than 6,000 ft.

Stored data 632 can be any data associated with a tankless water heater (including any components thereof), any measurements taken by sensors 642, time measured by the timer 606, adjustments to an algorithm 630, threshold values, user preferences, default values, results of previously run or calculated algorithms 630, water system variables such as the hardness of water in the system and/or any other suitable data. Such data can be any type of data, including but not limited to historical data for the water heater, calculations, adjustments made to calculations based on actual data, and measurements taken by one or more sensor devices. The stored data 632 can be associated with some measurement of time derived, for example, from the timer 606. Stored data 632 can include a predetermined threshold for high elevation. For example, higher than 5,000, 6,000, 7,000, 8,000, 9,000, or 10,000 ft. from sea level.

Examples of a storage repository 612 can include, but are not limited to, a database (or a number of databases), a file system, a hard drive, flash memory, some other form of solid state data storage, or any suitable combination thereof. The storage repository 612 can be located on multiple physical machines, each storing all or a portion of the protocols 628, the algorithms 630, and/or the stored data 632 according to some example embodiments. Each storage unit or device can be physically located in the same or in a different geographic location. The control engine 602 can perform its calculation of the elevation and needed amount of air at any time, but specifically can perform such a calculation at the initial installation start-up.

The energy metering module 608 of the controller 600 measures one or more components of power (e.g., current, voltage, resistance, VARs, watts) at one or more points (e.g., output of the power supply 622) associated with a water heater. The energy metering module 608 can include any of a number of measuring devices and related devices, including but not limited to a voltmeter, an ammeter, a power meter, an ohmmeter, a current transformer, a potential transformer, and electrical wiring.

The power module 610 can include one or more components (e.g., a transformer, a diode bridge, an inverter, a converter) that receives power (for example, through an electrical cable) from the power supply 622 and generates power of a type (e.g., AC, DC) and level (e.g., 12V, 24V, 120V) that can be used by the other components of the controller 600 and/or by the water heater.

The hardware processor 614 of the controller 600 executes software, algorithms 630, and firmware in accordance with one or more example embodiments. Specifically, the hardware processor 614 can execute software on the control engine 602 or any other portion of the controller 600, as well as software used by the user 626, the power supply 622, and the water heater (or portions thereof). The hardware processor 614 can be an integrated circuit, a central processing unit, a multi-core processing chip, SoC, a multi-chip module including multiple multi-core processing chips, or other hardware processor in one or more example embodiments. The hardware processor 614 is known by other names, including but not limited to a computer processor, a microprocessor, and a multi-core processor.

In one or more example embodiments, the hardware processor 614 executes software instructions stored in memory 616. The memory 616 includes one or more cache memories, main memory, and/or any other suitable type of memory. The memory 616 can include volatile and/or non-volatile memory. The memory 616 is discretely located within the controller 700 relative to the hardware processor 614 according to some example embodiments. In certain configurations, the memory 616 can be integrated with the hardware processor 614.

The transceiver 618 of the controller 600 can send and/or receive control and/or communication signals. Specifically, the transceiver 618 can be used to transfer data between the controller 600 and the user 626, the power supply 622, and a tankless water heater (or portions thereof). The transceiver 618 can use wired and/or wireless technology.

Memory 616 represents one or more computer storage media. Memory 716 includes volatile media (such as random access memory (RAM)) and/or nonvolatile media (such as read only memory (ROM), flash memory, optical disks, magnetic disks, and so forth). Memory 616 includes fixed media (e.g., RAM, ROM, a fixed hard drive, etc.) as well as removable media (e.g., a flash memory drive, a removable hard drive, an optical disk, and so forth).

The sensors 642 can be any sensor used in the operation of the premix combustion device. For example, the sensors 642 can be one or more of a temperature sensor or a pressure sensor, for example. In a particular example, a sensor 642 can be an elevation sensor. For example, the sensor 642 can be an altimeter which can be based on the measurement of atmospheric pressure.

One or more I/O devices 624 allow a customer, utility, or other user to enter commands and information to a tankless water heater, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a display, a monitor, or projector), speakers, outputs to a lighting network (e.g., DMX card), a printer, and a network card.

In some embodiments, during the initial installation set-up of a premix combustion system, the system can prompt the installer to enter the elevation. The elevation prompt can be for the actual elevation, or a binary prompt as to whether the installation is performed above a predetermined threshold, such as 2,000 ft., 3,000 ft., 4,000 ft., 5,000 ft., 6,000 ft., 7,000 ft., 8,000 ft., 9,000 ft., or 10,000 ft. If the elevation is higher than a predetermined threshold, the controller can automatically remove the plug from the additional air passageway (second air intake) or open a valve in the additional air passageway (second air intake). In some embodiments, the controller can prompt a user to remove a plug or stopper. If the actual elevation is entered, the controller can calculate the amount of air needed, determine a position of a valve in a second air intake in order to meet the amount of air needed, and send a signal to the valve to move to the determined position.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media."

Accordingly, the specific arrangement of steps should not be construed as limiting the scope. In addition, a particular computing device, as described, for example, in FIG. 6 above, is used to perform one or more of the steps for the methods described below in certain example embodiments. For the methods described below, unless specifically stated otherwise, a description of the controller 600 performing certain functions can be applied to the control engine 602 of the controller 600.

Accordingly, many modifications and other embodiments set forth herein will come to mind to one skilled in the art to which example modifiable premix combustion systems and premix blower assemblies pertain having the benefit of the teachings presented in the foregoing descriptions and the associated drawings. Therefore, it is to be understood that example modifiable premix combustion systems and premix blower assemblies are not to be limited to the specific embodiments disclosed and that modifications and other embodiments are intended to be included within the scope of this application. Although specific terms are employed herein, they are used in a generic and descriptive sense only and not for purposes of limitation.

The invention claimed is:

1. A premix blower assembly for a thermal transfer device comprising:

a premix blower;

a first air inlet fluidly connected to the premix blower;

a fuel inlet fluidly connected to the premix blower;

a venturi tube configured to receive air from the first air inlet and fuel from the fuel inlet and to direct the air from the first air inlet and the fuel from the fuel inlet to the premix blower; and a second air inlet directly fluidly connected to a side of the venturi tube, wherein the second air inlet comprises an adjustable opening.

2. The premix blower assembly of claim 1, wherein the fuel inlet is disposed between the first air inlet and the venturi tube.

3. The premix blower assembly of claim 1, wherein the fuel inlet is disposed between the first air inlet and the second air inlet.

4. The premix blower assembly of claim 1, wherein the second air inlet is disposed downstream from the fuel inlet.

5. The premix blower assembly of claim 1, wherein a central axis of the second air inlet extends transverse to a central axis of the venturi tube.

6. The premix blower assembly of claim 1, wherein the adjustable opening comprises one of a stopper, a valve, a shutter, or a baffle.

7. A water heating system comprising:

a premix blower assembly comprising:

a premix blower;

a first air inlet fluidly connected to the premix blower;

a fuel inlet fluidly connected to the premix blower;

a venturi tube configured to receive air from the first air inlet and fuel from the fuel inlet and to direct the air from the first air inlet and the fuel from the fuel inlet to the premix blower; and a second air inlet directly fluidly connected to a side of the venturi tube, wherein the second air inlet comprises an adjustable opening;

a manifold configured to receive a mixture of air and fuel from the premix blower assembly;

a combustion chamber fluidly connected to the manifold;

a water inlet;

a heat exchanger fluidly connected to the combustion chamber;

a heat exchanger pipe running through the heat exchanger comprising a heat exchange inlet fluidly connected to the water inlet;

a hot water outlet fluidly connected to a heat exchange outlet of the heat exchanger pipe; and an exhaust fluidly connected to the heat exchanger.

8. The water heater system of claim 7, wherein the fuel inlet the fuel inlet is disposed between the first air inlet and the venturi tube.

9. The water heating system of claim 7, wherein the fuel inlet is disposed between the first air inlet and the second air inlet.

10. The water heating system of claim 7, wherein the second air inlet is disposed downstream from the fuel inlet.

11. The water heating system of claim 7, wherein a central axis of the second air inlet extends transverse to a central axis of the venturi tube.

12. The water heating system of claim 7, wherein the adjustable opening comprises a stopper, a valve, a shutter, or a baffle.

13. The water heating system of claim 7, further comprising an elevation sensor.

14. The water heating system of claim 7, further comprising a controller, wherein the controller comprises processing circuitry, and wherein the controller is configured to receive a value associated with an elevation, determine if the second air inlet should be opened based on the value, and send a signal to the adjustable opening to open if so determined.

15. A premix combustion system comprising:

a premix blower assembly comprising:

a premix blower;

a first air inlet fluidly connected to the premix blower;

a fuel inlet fluidly connected to the premix blower;

a venturi tube configured to receive air from the first air inlet and fuel from the fuel inlet and to direct the air from the first air inlet and the fuel from the fuel inlet to the premix blower; and a second air inlet directly fluidly connected to a side of the venturi tube, wherein the second air inlet comprises an adjustable opening;

an air and fuel mixing chamber;

a burner fluidly connected to the air and fuel mixing chamber;

a heat exchanger configured to receive heated gases from the burner and transfer heat from the heated gases through one or more heat exchanger tubes; and an exhaust fluidly connected to the heat exchanger.

16. The premix combustion system of claim 15, wherein the mixing chamber comprises a manifold.

17. The premix combustion system of claim 15, wherein the premix combustion system is a furnace, a water heater, pool heater, or a tanked water heater.

18. The premix combustion system of claim 15, wherein the fuel inlet is disposed between the first air inlet and the second air inlet.

19. The premix combustion system of claim 15, wherein the adjustable opening comprises a stopper, a valve, a shutter, or a baffle.

20. The premix combustion system of claim 15, further comprising a controller, wherein the controller comprises processing circuitry, and wherein the controller is configured to receive a value associated with an elevation, determine if the second air inlet should be opened based on the received value, and send a signal to the adjustable opening to open if so determined.

* * * * *